US006219981B1

(12) United States Patent
Bergelt

(10) Patent No.: US 6,219,981 B1
(45) Date of Patent: Apr. 24, 2001

(54) LIGHTWEIGHT SUPPORT PIER

(76) Inventor: Philip R. Bergelt, 2615 N. Narcoossee Rd., St. Cloud, FL (US) 34771

( * ) Notice: Subject to any disclaimer, the term of this patent is extended or adjusted under 35 U.S.C. 154(b) by 0 days.

(21) Appl. No.: 09/510,737

(22) Filed: May 1, 2000

(51) Int. Cl.[7] ..... E02D 27/00

(52) U.S. Cl. ..... 52/294; 52/169.9; 52/596; 52/742.14; 52/405.1; 248/352

(58) Field of Search ..... 52/503, 169.9, 52/169.12, 299, 310, 292, 745.12, DIG. 3, 596, DIG. 11, 738.1, 405.1, 309.2; 248/352, 346.01, 146, 121

(56) References Cited

U.S. PATENT DOCUMENTS

| | | | | |
|---|---|---|---|---|
| 3,222,030 | | 12/1965 | Thorpe | 254/100 |
| 4,014,517 | | 3/1977 | Keagle | 254/45 |
| 4,517,781 | * | 5/1985 | LeBlanc | 52/299 |
| 4,895,335 | | 1/1990 | Oliver | 248/354.3 |
| 5,561,950 | | 10/1996 | Collins et al. | 52/126.6 |
| 5,595,366 | | 1/1997 | Cuisimano et al. | 248/354.3 |

* cited by examiner

*Primary Examiner*—Carl D. Friedman
*Assistant Examiner*—Naoko Slack
(74) *Attorney, Agent, or Firm*—Peter Loffler

(57) ABSTRACT

A structure support pier is used to support a mobile home or other similar structure. The pier has a base with a first flange and an optional second flange extending upwardly from the top surface of the base. A support pad is positioned on the top surface of the base. A shell member is positioned on the top surface of the base such that the outer periphery of the bottom of the shell member abuts the inner surface of the first flange. A support member, which may be a honeycomb structure, a plurality of tubular members, or other similar structure, has a first end resting on the support pad and a second end abutting the lower surface of the top of the shell member either directly or via a second support pad. The support member may be positioned within appropriate slits or depressions located on the support pads.

22 Claims, 4 Drawing Sheets

LIGHTWEIGHT SUPPORT PIER

BACKGROUND OF THE INVENTION

1. Field of the Invention

The present invention relates to a support pier for blocking mobile homes and other similar structures.

2. Background of the Prior Art

In setting up a mobile home, a manufactured building or other similar structures and objects, the structure must be blocked and supported. One simple method employed for blocking the structure is to use a plurality of concrete blocks stacked up on top of each other. As each concrete block has a limited footprint, each block stack has a limited weight capacity with respect to the ground. Therefore, in order to support modern structures, wherein several thousand pounds must typically be supported, two or more side by side block stacks must be established. Not only is a series of concrete block stacks aesthetically unpleasant, the need to bring a large number of concrete blocks to the job sight is expensive and labor intensive. Additionally, a relatively high concrete block stack may tend to be unstable under various loads and environmental conditions.

In order to overcome the problems of using only concrete blocks to support a structure various devices have been proposed. Such devices, although working with varying degrees of efficiency, tend to be difficult to use and maintain and are unduly heavy ad bulky.

Therefore, there is a need in the art for a structure support pier that addresses the above-stated problems in the art. Such a device must be capable of supporting several thousand pounds and must not be an eye sore. Such a device must be relatively lightweight and easy to transport, assemble and use. Ideally, such a device will be relatively inexpensive to manufacture and maintain.

SUMMARY OF THE INVENTION

The structure support pier of the present invention addresses the aforementioned needs in the art. The current invention provides a pier that is capable of supporting several thousand pounds and various types of structures and objects. The structure support pier is aesthetically pleasing. The device is relatively lightweight and easy to transport, assemble, and use and is relatively inexpensive to manufacture and maintain.

The structure support pier of the present invention is comprised of a base having a top surface, a bottom surface, and an outer edge. A first flange extends upwardly from the top surface and has an inner surface and an outer surface. A shell member having an open bottom with an outer periphery, a top with at least one side wall extending between the bottom and the top, the top having an upper surface and a lower surface, the shell member being positioned on the top surface such that the outer periphery of the bottom abuts against the inner surface of the first flange with the lower surface facing the top surface. The cross section of the top of the shell member is less than the cross section of the bottom of the shell member. A support pad is positioned on the top surface of the base and within the outer periphery of the bottom of the shell member. A support member has a first end positioned on the support pad of the base and a second end abutting the lower surface. The support member may be a honeycomb structure, a plurality of tubular members, or other similar structures. If the support member is a honeycomb structure, the support pad may have a plurality of slits disposed therein such that the honeycomb structure is disposed within the slits. If the support member is a plurality of tubular members, a plurality of depressions can be located within the support pad with each tubular member disposed within a respective one of the plurality of depressions and a similar support pad can be positioned over the opposing end of the tubular members. A second flange may extend upwardly from the top surface and is positioned between the outer edge and the first flange while a third flange may extend upwardly from the upper surface of the shell member. Each of the second flange, the third flange and the base may have any opening therein for releasing any moisture trapped by the respective flange. Concrete may be pumped into the shell member.

The structure support pier of the present invention is easy to assemble and disassemble, and several shell members can be stacked within one another for easy transportation of several devices of the present invention.

BRIEF DESCRIPTION OF THE DRAWINGS

Similar reference numerals refer to similar parts throughout the several views of the drawings.

DESCRIPTION OF THE PREFERRED EMBODIMENT

Figure 1:
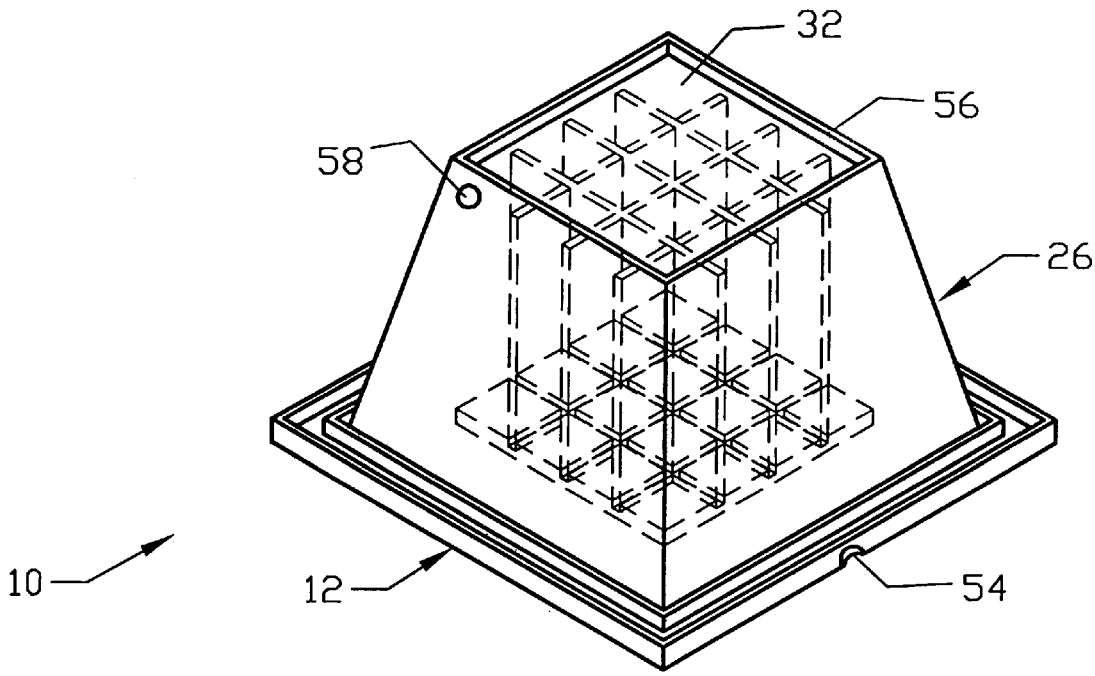
FIG. 1 is a perspective view of the structure support pier of the present invention using a honeycomb support structure.

Referring now to the drawings, it is seen that the structure support pier of the present invention, generally denoted by reference numeral 10, is comprised of a base 12 having a top surface 14, a bottom surface 16, and an outer edge 18. A first flange 20 extends upwardly from the top surface 14 and has an inner surface 22 and an outer surface 24. A shell member 26 has an open bottom 28 with an outer periphery 30, a top 32 and at least one side wall 34 extending between the bottom 28 and the top 32. The top 32 has an upper surface and a lower surface. The shell member 26 is positioned on the top surface 14 of the base 12 such that the outer periphery 30 of the bottom 28 abuts against the inner surface 22 of the first flange 20 with the lower surface of the top 32 of the shell member 26 facing the top surface 14 of the base 12. The cross section of the top 32 of the shell member 26 is less than the cross section of the bottom 28 of the shell member 26 so that the side wall 34 of the shell member 26 tapers outwardly in extending from the top 32 to the bottom 28.

Figure 2:
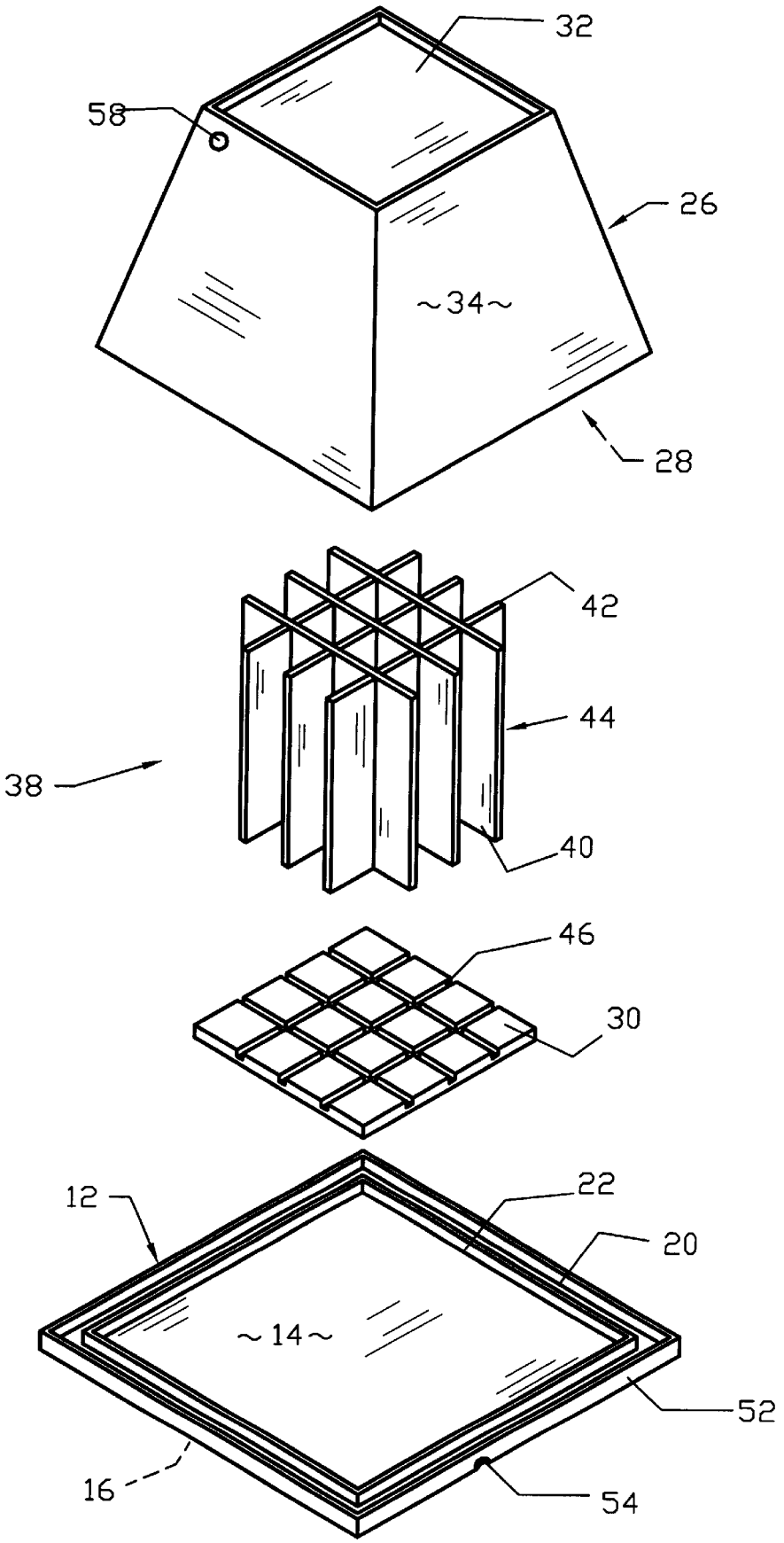
FIG. 2 is an exploded view of FIG. 1.

A support pad 36 is positioned on the top surface 14 of the base 12 and within the outer periphery 30 of the bottom 28 of the shell member 26. The support pad 36 may be integrally formed with the base 12 or can be a separate item. A support member, having reference number 38 generally, has a first end 40 positioned on the support pad 36 of the base 12 and a second end 42 abutting the lower surface of the top 32, either directly or via a second support pad 36. As illustrated in FIGS. 1 and 2, the support member 38 may be a honeycomb structure 44. As such the support pad 36 has a plurality of slits 46 disposed therein such that the honeycomb structure is disposed within the slits 44, the slits 44 dimensioned such that the honeycomb structure 44 fits relatively snugly within the slits 46.

Figure 3:
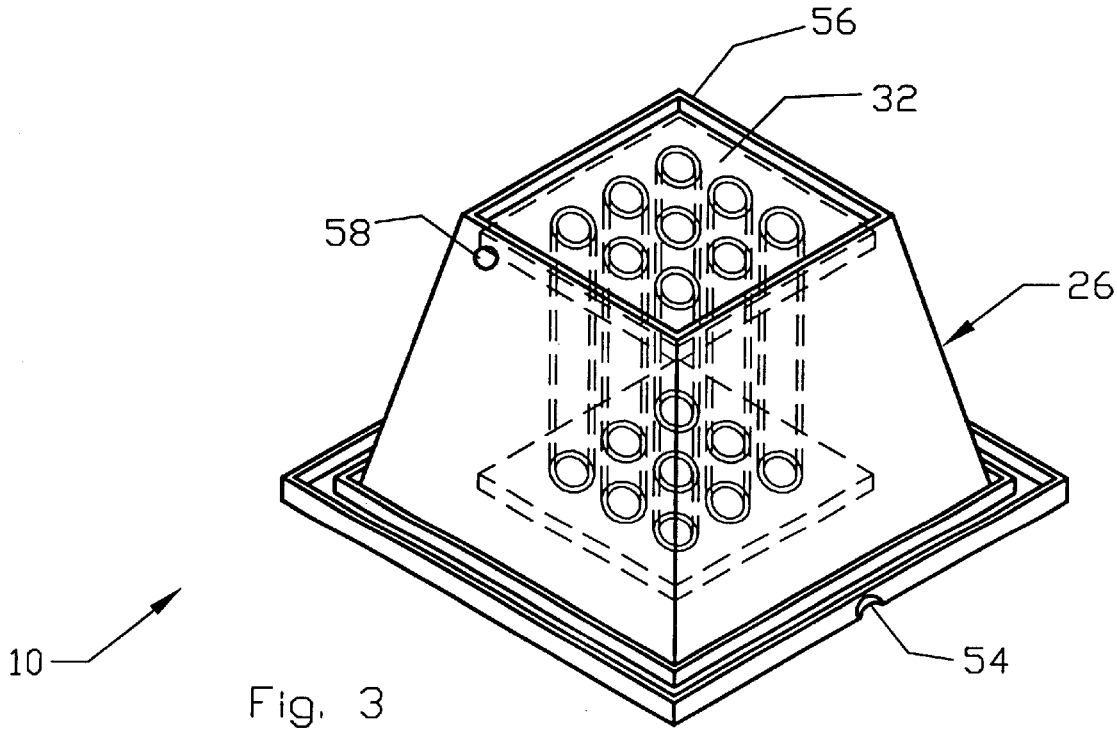
FIG. 3 is a perspective view of the structure support pier of the present invention using a tubular member support structure.
Figure 4:
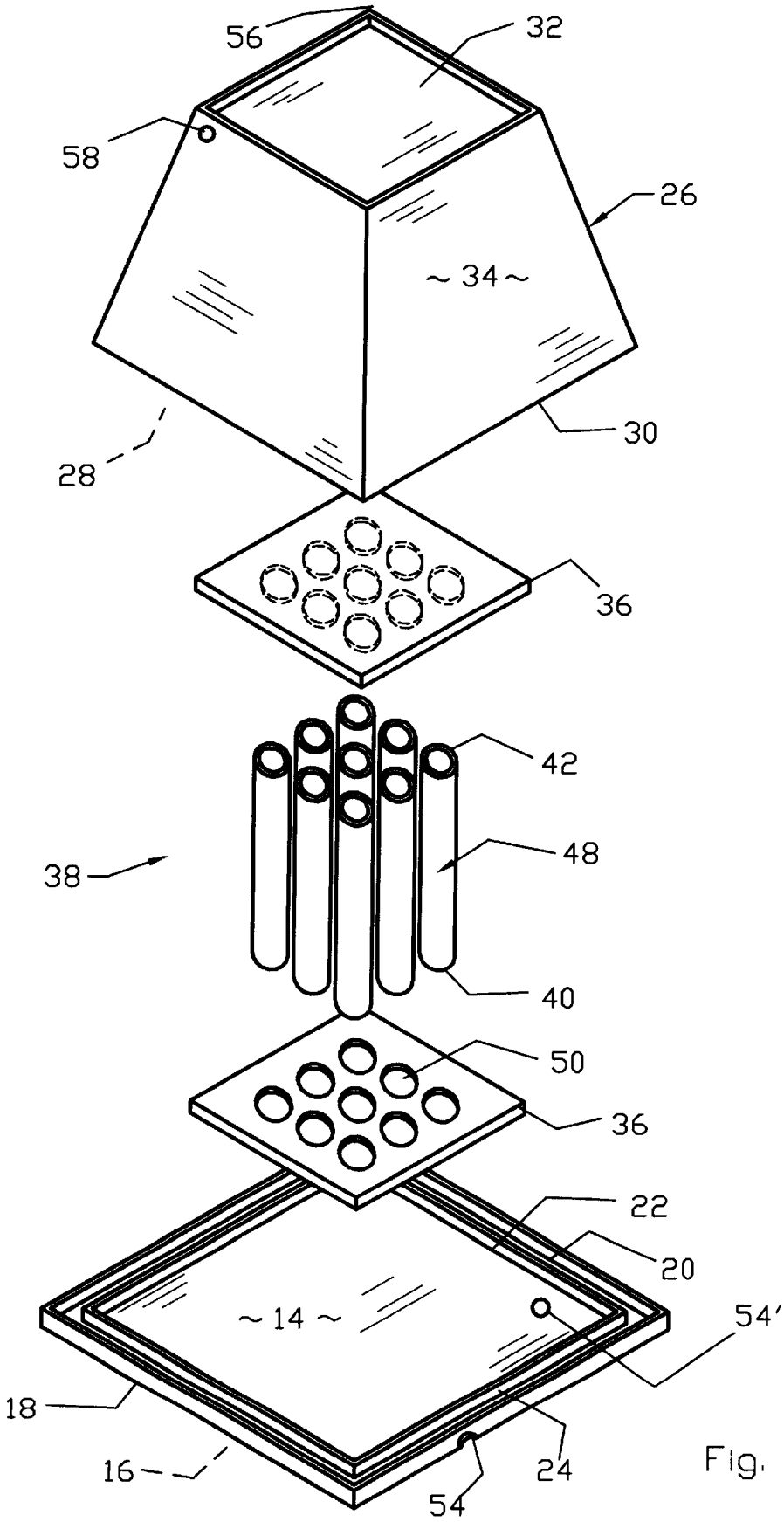
FIG. 4 is an exploded view of FIG. 3.
Figure 5:
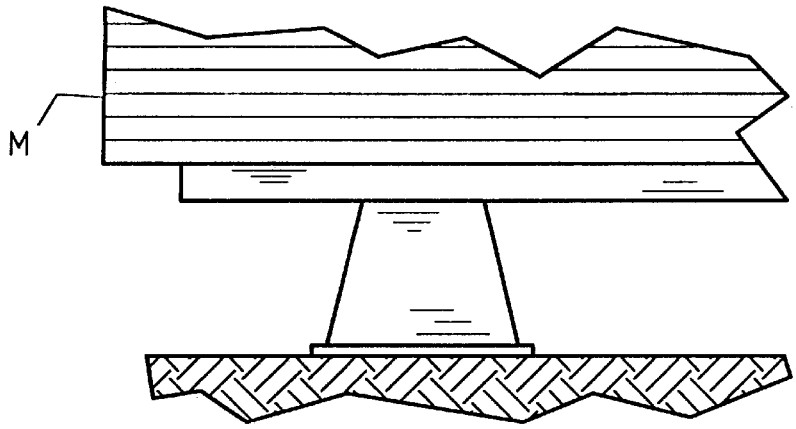
FIG. 5 is an environmental view of the structure support pier supporting a structure.
Figure 6:
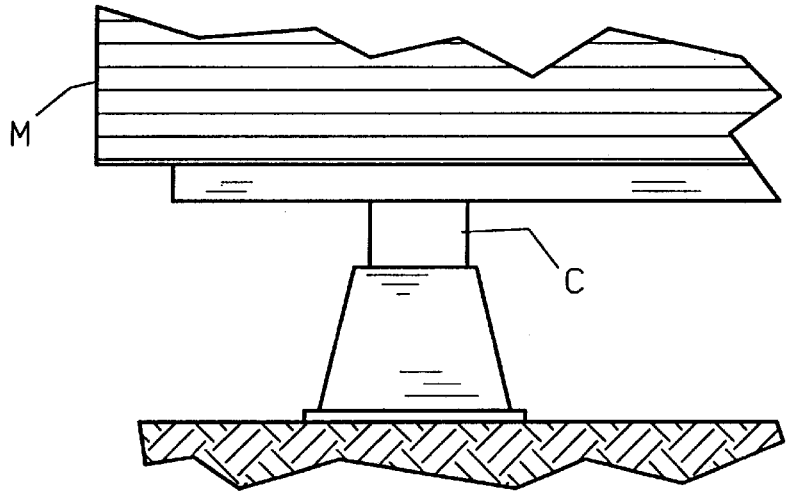
FIG. 6 is an environmental view of the structure support pier supporting a structure and utilizing a concrete block riser.

Alternately, as illustrated in FIGS. 3 and 4, the support member 38 may be a plurality of tubular members 48. As such, a plurality of depressions 50 can be located within the support pad 36 with each tubular member 48 disposed within a respective one of the plurality of depressions 50, the depressions 50 dimensioned such that each tubular member 48 fits relatively snugly within its respective depression 50. Each tubular member 50 may be connected to one or more other tubular members 50 or each may be independent of the other tubular member 50.

A second flange 52 may extend upwardly from the top surface 14 and is positioned between the outer edge 18 and the first flange 20. An opening 54 is located within the second flange 52, within the base 12, or both in order to allow any moisture trapped between the first flange 20 and the second flange 52 to escape.

A third flange 56 extends upwardly from the top 32 of the shell member 26. An opening 58 is located within the third flange 56 to allow any moisture trapped by the third flange 56.

The various components of the structure support pier 10 of the present invention can be made from any appropriate material such as high strength (ABS etc.,) plastic, rubber, recycled polymaterials, high strength carbons, metal, aluminum, etc., or any combination thereof.

In order to use the structure-support pier 10 of the present invention, the base 12 is placed on the ground whereat the mobile home M or other similar structure is to be supported. If used, the support pad 36 is placed on the top surface 14 of the base 12 within the first flange 20. The support member 38 is placed onto the support pad 36 and is received within the slits 46 or depressions 50 as appropriate. If desired, a second support pad 36 is placed on the second end 42 of the support member 38. The shell member 26 is placed onto the top surface 14 of the base 12 such that the outer periphery 30 of the shell member 26 abuts against the inner surface 22 of the first flange 20. The structure support pier 10 is now ready to receive a load M. The load of the supported structure M that is placed onto the top 32 of the shell member 26 or on the third flange 56 extending upwardly from the top 32. The load of the supported structure M is transferred the base 12 via the shell member 26 and the support member 38. The multiple cell configuration of the support member 38 and the side wall 34 extending outwardly from the top 32 to the bottom 28 of the shell member 26 help diffuse the load throughout the entire surface of the base 12. This allows a relatively concentrated load to be placed onto the top 32 of the shell member 26 to be spread out across the relatively larger base 12. If needed, one or more concrete blocks C or other similar devices can be placed between the shell member 26 and the structure M being supported to act as a riser.

Figure 7:
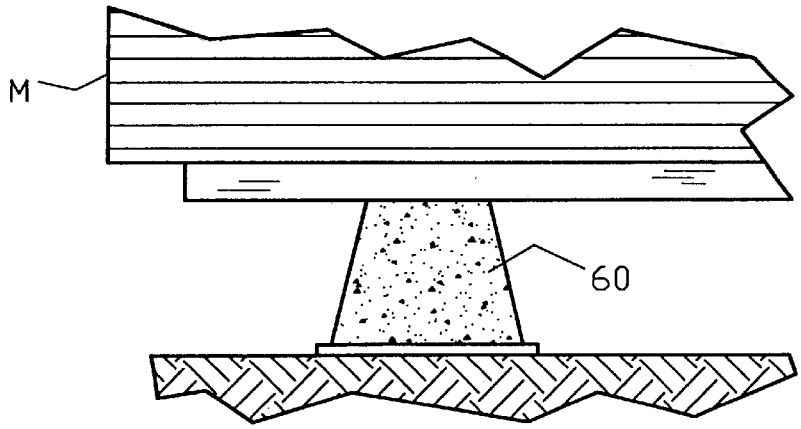
FIG. 7 is an environmental view of the structure support pier supporting a structure with concrete pumped into the shell member and the shell member subsequently removed.

If desired, after the device 10 is assembled, concrete 60 can be pumped into the shell member 26 through an appropriate opening (not illustrated) in order to add further load bearing capacity to the device 10. If further desired, the shell member 26 can be used to act as a form, with the shell member 26 removed after the concrete 60 has been poured. In such an embodiment, the structure M to be supported will rest directly on the concrete 60, as illustrated in FIG. 7.

While the invention has been particularly shown and described with reference to an embodiment thereof, it will be appreciated by those skilled in the art that various changes in form and detail may be made without departing from the spirit and scope of the invention.

I claim:

1. A support pier comprising:

a base having a top surface, a bottom surface, and an outer edge;

a first flange extending upwardly from the top surface, the first flange having an inner surface and an outer surface;

a shell member having an open bottom and having an outer periphery, a top and at feast one side wall extending between the bottom and the top, the top having an upper surface and a lower surface, the shell member positioned on the top surface such that the outer periphery of the bottom abuts against the inner surface of the first flange such that the lower surface faces the top surface; and a support member having a first end positioned on the top surface of the base and a second end abutting the lower surface.

2. The support pier as in claim 1 further comprising a second flange extending upwardly from the top surface and positioned between the outer edge and the first flange.

3. The support pier as in claim 2 further comprising an opening located within the second flange.

4. The support pier as in claim 1 wherein the bottom of the shell member has a first cross section and the top of the shell member has a second cross section that is smaller than the first cross section.

5. The support pier as in claim 1 wherein the support member comprises a honeycomb structure.

6. The support pier as in claim 1 wherein the support member comprises a plurality of tubular members.

7. The support pier as in claim 1 further comprising a second flange extending upwardly from the upper surface of the shell member.

8. The support pier as in claim 7 further comprising an opening located within the second flange.

9. The support pier as in claim 1 further comprising an opening located within the base.

10. The support structure as in claim 1 further comprising concrete pumped into the shell member.

11. A support pier comprising:

a base having a top surface, a bottom surface, and an outer edge;

a first flange extending upwardly from the top surface, the first flange having an inner surface and an outer surface;

a shell member having an open bottom and having an outer periphery, a top and at least one side wall extending between the bottom and the top, the top having an upper surface and a lower surface, the shell member positioned on the top surface such that the outer periphery of the bottom abuts against the inner surface of the first flange such that the lower surface faces the top surface;

a support pad positioned on the top surface of the base and within the outer periphery of the bottom of the shell member; and a support member having a first end positioned on the support pad of the base and a second end abutting the lower surface.

12. The support pier as in claim 11 further comprising a second flange extending upwardly from the top surface and positioned between the outer edge and the first flange.

13. The support pier as in claim 12 further comprising an opening located within the second flange.

14. The support pier as in claim 11 wherein the bottom of the shell member has a first cross section and the top of the shell member has a second cross section that is smaller than the first cross section.

15. The support pier as in claim 11 wherein the support member comprises a honeycomb structure.

16. The support pier as in claim 15 further comprises a plurality of slits located on the support pad such that the honeycomb structure is positioned within the slits.

17. The support pier as in claim 11 wherein the support member comprises a plurality of tubular members.

18. The support pier as in claim 17 further comprising a plurality of depressions disposed within the support pad such that each of the plurality of tubular members is positioned within a respective one of the plurality of depressions.

19. The support pier as in claim 11 further comprising a second flange extending upwardly from the upper surface of the shell member.

20. The support pier as in claim 19 further comprising an opening located within the second flange.

21. The support pier as in claim 11 further comprising an opening located within the base.

22. The support structure as in claim 11 further comprising concrete pumped into the shell member.

* * * * *